US011735353B2

(12) United States Patent
Hirai et al.

(10) Patent No.: US 11,735,353 B2
(45) Date of Patent: Aug. 22, 2023

(54) INDUCTOR COMPONENT AND METHOD OF MANUFACTURING SAME

(71) Applicant: Murata Manufacturing Co., Ltd., Kyoto-fu (JP)

(72) Inventors: Shinya Hirai, Nagaokakyo (JP); Koki Okamura, Nagaokakyo (JP); Akinori Hamada, Nagaokakyo (JP); Tomohiro Kido, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 751 days.

(21) Appl. No.: 16/243,867

(22) Filed: Jan. 9, 2019

(65) Prior Publication Data

US 2019/0244743 A1 Aug. 8, 2019

(30) Foreign Application Priority Data

Feb. 2, 2018 (JP) ..... 2018-017544

(51) Int. Cl.

| | |
|---|---|
| ***H01F 5/00*** | (2006.01) |
| ***H01F 27/28*** | (2006.01) |
| ***H01F 27/32*** | (2006.01) |
| ***H01F 41/04*** | (2006.01) |
| ***H01F 27/24*** | (2006.01) |
| ***H01F 41/12*** | (2006.01) |
| ***H01F 27/29*** | (2006.01) |
| ***H01F 17/00*** | (2006.01) |

(52) U.S. Cl.

CPC ..... *H01F 27/2804* (2013.01); *H01F 17/0013* (2013.01); *H01F 27/24* (2013.01); *H01F 27/29* (2013.01); *H01F 27/32* (2013.01); *H01F 27/324* (2013.01); *H01F 41/041* (2013.01); *H01F 41/046* (2013.01); *H01F 41/12* (2013.01); *H01F 2017/0066* (2013.01)

(58) Field of Classification Search

USPC ..... 336/200

See application file for complete search history.

(56) References Cited

U.S. PATENT DOCUMENTS 8,248,200 B2 * 8/2012 Ishimoto ..... H01F 17/0006 336/192
10,672,555 B2 * 6/2020 Fukuda ..... H01F 27/292
(Continued)

FOREIGN PATENT DOCUMENTS

CN 104575987 A 4/2015
CN 106816263 A 6/2017
(Continued)

OTHER PUBLICATIONS

An Office Action; "Decision of Refusal," mailed by the Japanese Patent Office dated Nov. 4, 2020, which corresponds to Japanese Patent Application No. 2018-017544 and is related to U.S. Appl. No. 16/243,867 with English language translation.
(Continued)

*Primary Examiner* — Ronald Hinson
(74) *Attorney, Agent, or Firm* — Studebaker & Brackett PC

(57) ABSTRACT

An inductor component comprising an insulating layer containing no magnetic substance, a spiral wiring formed on a first principal surface of the insulating layer and wound on the first principal surface, and a magnetic layer in contact with at least a portion of the spiral wiring.

18 Claims, 8 Drawing Sheets

(56) References Cited

U.S. PATENT DOCUMENTS

| | | | | |
|---|---|---|---|---|
| 11,101,065 | B2 * | 8/2021 | Yoon | H01F 17/0013 |
| 2008/0100409 | A1 * | 5/2008 | Nishikawa | H01F 17/0006 336/200 |
| 2013/0249662 | A1 * | 9/2013 | Tonoyama | H01F 17/0013 336/200 |
| 2015/0102890 | A1 | 4/2015 | Nakamura et al. | |
| 2015/0145629 | A1 * | 5/2015 | Chang | H01F 17/0006 336/192 |
| 2015/0170823 | A1 * | 6/2015 | Jeong | H01F 17/0013 336/200 |
| 2017/0098997 | A1 | 4/2017 | Hamada et al. | |
| 2017/0148562 | A1 | 5/2017 | Lee et al. | |
| 2017/0213639 | A1 | 7/2017 | Kudo et al. | |
| 2017/0345551 | A1 | 11/2017 | Yoshioka et al. | |
| 2018/0277296 | A1 * | 9/2018 | Endo | H01F 41/046 |
| 2018/0286568 | A1 * | 10/2018 | Suzuki | H01F 41/122 |

FOREIGN PATENT DOCUMENTS

| | | | |
|---|---|---|---|
| CN | 107452492 | A | 12/2017 |
| JP | 2007-305824 | A | 11/2007 |
| JP | 2013-225718 | A | 10/2013 |
| JP | 2015-076597 | A | 4/2015 |
| JP | 2017-069523 | A | 4/2017 |
| JP | 2017-098544 | A | 6/2017 |
| JP | 2017-130584 | A | 7/2017 |
| JP | 2017-199799 | A | 11/2017 |
| JP | 2017-216773 | A | 12/2017 |

OTHER PUBLICATIONS

An Office Action; "Notification of Reasons for Refusal," mailed by the Japanese Patent Office dated Mar. 17, 2020, which corresponds to Japanese Patent Application No. 2018-017544 and is related to U.S. Appl. No. 16/243,867 with English language translation.

An Office Action issued by the China National Intellectual Property Administration dated Aug. 3, 2020, which corresponds to Chinese Patent Application No. 201910090280.2 and is related to U.S. Appl. No. 16/243,867 with English language translation.

An Office Action; "Notice of Reasons for Refusal," mailed by the Japanese Patent Office dated Mar. 22, 2022, which corresponds to Japanese Patent Application No. 2021-004237 and is related to U.S. Appl. No. 16/243,867 with English language translation.

* cited by examiner

INDUCTOR COMPONENT AND METHOD OF MANUFACTURING SAME

CROSS REFERENCE TO RELATED APPLICATION

This application claims benefit of priority to Japanese Patent Application 2018-017544 filed Feb. 2, 2018, the entire content of which is incorporated herein by reference.

BACKGROUND

Technical Field

The present disclosure relates to an inductor component and a method of manufacturing the same.

Background Art

A conventional inductor component is described in Japanese Laid-Open Patent Publication No. 2013-225718. This inductor component includes an insulating substrate, a spiral conductor formed on a principal surface of the insulating substrate, an insulating resin layer covering the spiral conductor, an upper core and a lower core covering the upper-surface side and the back-surface side of the insulating substrate, and a pair of terminal electrodes. The insulating substrate is a general printed circuit board material in which a glass cloth is impregnated with epoxy resin, and the size of the insulating substrate is 2.5 mm×2.0 mm×0.3 mm. The upper core and the lower core are made of metal magnetic powder-containing resin.

An inductor component described in Japanese Laid-Open Patent Publication No. 2007-305824 includes a sheet-shaped element body, a planar coil constituting a coil formed in the element body, and a terminal formed in an outermost circumferential portion of the coil. The element body is a laminated body of insulating layers using photoresist. The terminal is partially made of a magnetic substance. A magnetic center-leg part made of a magnetic substance is formed in an inner circumferential direction of the coil in the element body. This inductor component is formed by laminating the element body etc. on a substrate of silicon etc. and then removing the substrate by a hydrofluoric acid treatment etc.

SUMMARY

In Japanese Laid-Open Patent Publication No. 2013-225718, a spiral conductor is formed on an insulating substrate of a printed circuit board material on the order of several hundreds of micrometers, which puts limitations on reduction in height of the entire inductor component. Additionally, for example, considering that the insulating substrate is removed by etching or polishing as in Japanese Laid-Open Patent Publication No. 2007-305824 so as to achieve a height reduction in the structure of Japanese Laid-Open Patent Publication No. 2013-225718, a portion of a bottom surface of the spiral conductor is highly likely to be removed together at the time of removal of the insulating substrate since the spiral conductor is formed immediately above the insulating substrate in Japanese Laid-Open Patent Publication No. 2013-225718. If the spiral conductor is removed in this way, a DC resistance (Rdc) increases (deteriorates), and a removal amount of the spiral conductor inevitably varies each time at a removal step during mass production, which also causes variations in Rdc.

Since the spiral conductor is covered with the insulating resin layer in Japanese Laid-Open Patent Publication No. 2013-225718, and the element body is photoresist (nonmagnetic substance) in Japanese Laid-Open Patent Publication No. 2007-305824, the insulating resin layer or the photoresist accounts for a large proportion of the entire component. Therefore, as components are increasingly reduced in size and height, a sufficient formation region can no longer be ensured for a magnetic substance (the core of Japanese Laid-Open Patent Publication No. 2013-225718, the magnetic terminal and the magnetic center-leg part of Japanese Laid-Open Patent Publication No. 2007-305824) and a wiring (the spiral conductor of Japanese Laid-Open Patent Publication No. 2013-225718 and the planar coil of Japanese Laid-Open Patent Publication No. 2007-305824), which may make it impossible to sufficiently ensure both inductance (L) and Rdc. Therefore, either or both of L and Rdc may be sacrificed due to the reduction in size and height.

As described above, it cannot be said the conventional inductor components have a configuration suitably reduced in size and height.

Therefore, the present disclosure provides an inductor component suitably reduced in size and height and a method of manufacturing the same.

An aspect of the present disclosure provides an inductor component comprising an insulating layer containing no magnetic substance; a spiral wiring formed on a first principal surface of the insulating layer and wound on the first principal surface; and a magnetic layer in contact with at least a portion of the spiral wiring.

The spiral wiring may be a curve (two-dimensional curve) formed in a plane and having the number of turns exceeding one or may be a curve having the number of turns less than one and may have a portion that is a straight line.

According to the inductor component of the present disclosure, since the spiral wiring is formed on the first principal surface of the insulating layer, the spiral wiring is protected against a processing process of substrate removal (etching, polishing, etc.) from the second principal surface side (lower side) of the insulating layer. This enables suppression of an increase in DC resistance (Rdc) and variations in Rdc during mass production.

Additionally, since the magnetic layer is in contact with the spiral wiring, the insulating layer accounts for a less proportion of the entire inductor component, so that a formation region can be ensured for the spiral wiring and the magnetic layer. This enables an improvement in trade-off relationship between inductance (L) and Rdc.

Therefore, the inductor component suitably reduced in size and height can be implemented.

In an embodiment of the inductor component, the magnetic layer is in contact with a side surface of the spiral wiring in a contact portion with the spiral wiring. According to this embodiment, the proportion of the insulating layer is reduced.

In an embodiment of the inductor component, the magnetic layer is in contact with an upper surface of the spiral wiring in a contact portion with the spiral wiring. According to this embodiment, the proportion of the insulating layer is reduced.

In an embodiment of the inductor component, the magnetic layer is in contact with the spiral wiring from a side surface to an upper surface thereof in a contact portion with the spiral wiring. According to this embodiment, the proportion of the insulating layer is further reduced.

In an embodiment of the inductor component, the insulating layer has a thickness smaller than a thickness of the spiral wiring. According to this embodiment, the proportion of the insulating layer is further reduced.

In an embodiment of the inductor component, the insulating layer has a thickness of 10 μm or less. According to this embodiment, the proportion of the insulating layer is further reduced.

In an embodiment of the inductor component, the insulating layer has a shape along the spiral wiring. According to this above embodiment, since the insulating layer is not disposed in a region where the spiral wiring is not formed, the proportion of the insulating layer is further reduced.

In an embodiment of the inductor component, the inductor component further comprises a columnar wiring penetrating the inside of the magnetic layer in a normal direction of the first principal surface and an external terminal formed outside the magnetic layer. Also, the spiral wiring is in direct contact with the columnar wiring while the columnar wiring is in direct contact with the external terminal.

According to the above embodiment, the absence of a via conductor enables a reduction in height of the inductor component, a reduction in Rdc, and an improvement in connection reliability.

In an embodiment of the inductor component, the spiral wiring is only one layer. According to this above embodiment, the inductor component can be reduced in height.

In an embodiment of the inductor component, the side surface of the spiral wiring is all in contact with the magnetic layer. According to this embodiment, the proportion of the insulating layer is further reduced.

In an embodiment of the inductor component, the upper surface of the spiral wiring is all in contact with the magnetic layer except a portion in contact with the columnar wiring. According to this embodiment, the proportion of the insulating layer is further reduced.

In an embodiment of the inductor component, the spiral wiring has a spiral shape exceeding one round, and the side surface of the spiral wiring is covered with the insulating layer in a parallelly-running region of the spiral wiring exceeding one round. According to this embodiment, the spiral wiring can be improved in insulation and voltage resistance.

In an embodiment of a method of manufacturing an inductor component, the method comprises the steps of preparing a substrate; forming an insulating layer containing no magnetic substance on the substrate; forming a spiral wiring on a first principal surface of the insulating layer such that the spiral wiring is wound on the first principal surface; forming a magnetic layer on the insulating layer in contact with at least a portion of the spiral wiring; and removing the substrate.

According to the above embodiment, when the substrate is removed, the spiral wiring is protected by the insulating layer, so that an increase in Rdc and variations in Rdc during mass production can be suppressed. Since the magnetic layer is in contact with the spiral wiring, the insulating layer accounts for a less proportion of the entire inductor component, so that the trade-off relationship between L and Rdc can be improved. Therefore, the inductor component suitably reduced in size and height can be manufactured.

In an embodiment of the method of manufacturing an inductor component, the insulating layer is removed while leaving a portion along the spiral wiring. According to this embodiment, the proportion of the insulating layer is further reduced.

In an embodiment of the method of manufacturing an inductor component, a columnar wiring extending from the spiral wiring in a normal direction of the first principal surface is formed after formation of the spiral wiring and before formation of the magnetic layer, and the magnetic layer is formed such that an upper end of the columnar wiring is exposed. According to this embodiment, the absence of a via conductor enables a reduction in height of the inductor component, a reduction in Rdc, and an improvement in connection reliability.

According to the inductor component and the method of manufacturing the same according to an embodiment of the present disclosure, the inductor component suitably reduced in size and height can be implemented.

DETAILED DESCRIPTION

An aspect of the present disclosure will now be described in detail with reference to shown embodiments.

First Embodiment (Configuration)

Figure 1:
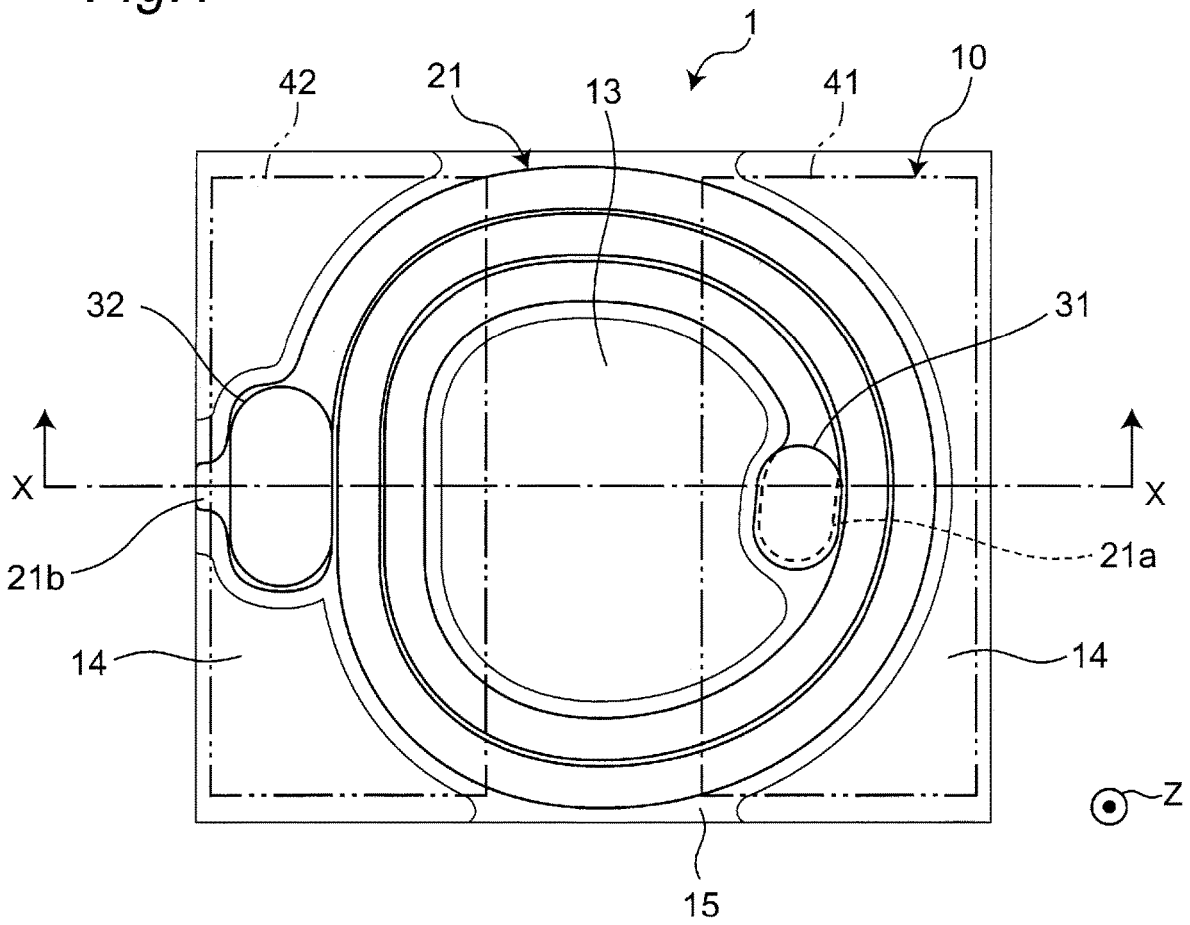
FIG. 1 is a transparent plan view of an inductor component according to a first embodiment.
Figure 2:
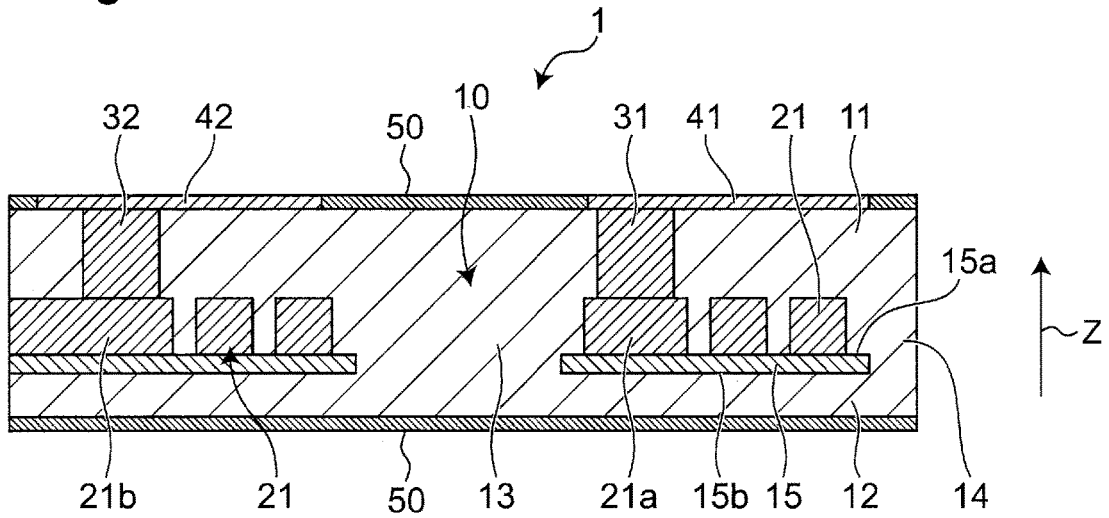
FIG. 2 is a cross-sectional view of the inductor component according to the first embodiment.

FIG. 1 is a transparent plan view of a first embodiment of an inductor component. FIG. 2 is a cross-sectional view taken along a line X-X of FIG. 1.

An inductor component 1 is mounted on an electronic device such as a personal computer, a DVD player, a digital camera, a TV, a portable telephone, and automotive electronics, for example, and is a component generally having a rectangular parallelepiped shape, for example. However, the shape of the inductor component 1 is not particularly limited and may be a circular columnar shape, a polygonal columnar shape, a truncated cone shape, or a truncated polygonal pyramid shape.

As shown in FIGS. 1 and 2, the inductor component 1 has a magnetic layer 10, an insulating layer 15, a spiral wiring 21, columnar wirings 31, 32, external terminals 41, 42, and a coating film 50.

The insulating layer 15 has a first principal surface 15*a* as an upper surface and a second principal surface 15*b* as a lower surface. A normal direction relative to the first principal surface 15*a* of the insulating layer 15 is defined as a Z direction in the figures, and it is assumed that a forward Z direction faces toward the upper side while a reverse Z direction faces toward the lower side.

The insulating layer 15 is a layer having a shape along the spiral wiring 21 when viewed from above. Therefore, the insulating layer 15 is not disposed in a region where the spiral wiring 21 is not formed, so that the proportion of the insulating layer 15 is further reduced in the entire inductor component 1. Although the insulating layer 15 is coupled in a region between wirings of the spiral wiring 21 in the drawings, the layer may be divided in the region between wirings of the spiral wiring 21. The insulating layer 15 may be a flat plate-shaped layer instead of the shape along the spiral wiring 21.

The thickness of the insulating layer 15 is preferably smaller than the spiral wiring 21, and the proportion of the insulating layer 15 is further reduced. The thickness of the insulating layer 15 is preferably 10 μm or less, and the proportion of the insulating layer 15 is further reduced.

The insulating layer 15 is made of an insulating material containing no magnetic substance and is made of, for example, a resin material such as an epoxy resin, a phenol resin, a polyimide resin, or an inorganic material such as an oxide film and a nitride film of silicon or aluminum. Since the insulating layer 15 contains no magnetic substance, the flatness of the first principal surface 15*a* of the insulating layer 15 can be ensured to favorably form the spiral wiring 21 on the first principal surface 15*a*, and conduction can be prevented between wirings of the spiral wiring 21. The insulating layer 15 preferably has a configuration not containing a filler, and in this case, the insulating layer 15 can be formed as a thinner film and improved in the flatness. On the other hand, if the insulating layer 15 contains a non-magnetic filler such as silica, the insulating layer 15 can be improved in the strength, workability, and electrical characteristics.

The spiral wiring 21 is formed on the first principal surface 15*a* of the insulating layer 15 and is wound on the first principal surface 15*a*. The spiral wiring 21 has a spiral shape with the number of turns exceeding one. The spiral wiring 21 is spirally wound in a clockwise direction from an outer circumferential end 21*b* toward an inner circumferential end 21*b* when viewed from the upper side.

The thickness of the spiral wiring 21 is preferably larger than the thickness of the insulating layer 15 and is preferably 40 μm or more and 120 μm or less (i.e., from 40 μm to 120 μm), for example. An example of the spiral wiring 21 has a thickness of 45 μm, a wiring width of 40 μm, and an inter-wiring space of 10 μm. The inter-wiring space is preferably 3 μm or more and 20 μm or less (i.e., from 3 μm to 20 μm).

The spiral wiring 21 is made of a conductive material and is made of a metal material having a low electric resistance such as Cu, Ag, and Au, for example. In this embodiment, the inductor component 1 includes only one layer of the spiral wiring 21, so that the inductor component 1 can be reduced in height. Specifically, the spiral wiring 21 has both ends (the inner circumferential end 21*a* and the outer circumferential end 21*b*) provided with pad portions having a line width slightly larger than a spirally-shaped portion and is directly connected at the pad portions to the columnar wirings 31, 32.

The magnetic layer 10 is formed to cover the first principal surface 15*a* and the second principal surface 15*b* of the insulating layer 15 on which the spiral wiring 21 is formed. The magnetic layer 10 is in contact with at least a portion of the spiral wiring 21, or specifically, is in contact with the spiral wiring 21 from a side surface to an upper surface thereof in a contact portion with the spiral wiring. Particularly, in this embodiment, the spiral wiring 21 is in contact with the insulating layer 15 only at the bottom surface thereof, while the side surface of the spiral wiring 21 is all in contact with the magnetic layer 10, and the upper surface of the spiral wiring 21 is all in contact with the magnetic layer 10 except the portions in contact with the columnar wiring 31, 32. Therefore, the proportion of the insulating layer 15 can further be reduced.

The magnetic layer 10 is made up of a first magnetic layer 11, a second magnetic layer 12, an inner magnetic path part 13, and an outer magnetic path part 14. In FIG. 1, a portion of the magnetic layer 10 is made transparent. The first magnetic layer 11 and the second magnetic layer 12 are located at positions sandwiching the spiral wiring 21 from both sides in the Z direction. Specifically, the first magnetic layer 11 is located on the upper side of the spiral wiring 21, and the second magnetic layer 12 is located on the lower side of the spiral wiring 21. The inner magnetic path part 13 and the outer magnetic path part 14 are arranged on the inside and the outside, respectively, of the spiral wiring 21 as shown in FIG. 1 and connected to the first magnetic layer 11 and the second magnetic layer 12 as shown in FIG. 2. In this way, the magnetic layer 10 constitutes a closed magnetic path with respect to the spiral wiring 21.

The magnetic layer 10 is made of a magnetic material and is made of a resin containing a powder of a magnetic material, for example. The resin constituting the magnetic layer 10 is, for example, an epoxy resin, a phenol resin, or a polyimide resin, and the powder of the magnetic material is, for example, a powder of metal magnetic material including an FeSi alloy such as FeSiCr, an FeCo alloy, an Fe alloy such as NiFe, or an amorphous alloy thereof, or a powder of ferrite etc. The content percentage of the magnetic material is preferably 50 vol % or more and 85 vol % or less (i.e., from 50 vol % to 85 vol %) relative to the whole magnetic layer 10. The powder of the magnetic material preferably has particles of substantially spherical shape, and the average particle diameter is preferably 5 μm or less. The magnetic layer 10 may be a ferrite substrate etc. If the magnetic material is made of a resin, it is preferable to use the same material as the insulating layer 15 and, in this case, the adhesion between the insulating layer 15 and the magnetic layer 10 can be improved.

The columnar wirings 31, 32 are wirings penetrating the inside of the magnetic layer 10 in the normal direction of the first principal surface 15*a* of the insulating layer 15. In this embodiment, the first columnar wiring 31 extends upward from the upper surface of the inner circumferential end 21*a* of the spiral wiring 21 and penetrates the inside of the first magnetic layer 11. The second columnar wiring 32 extends upward from the upper surface of the outer circumferential end 21*b* of the spiral wiring 21 and penetrates the inside of the first magnetic layer 11. The columnar wirings 31, 32 are made of the same material as the spiral wiring 21.

The external terminals 41, 42 are terminals formed outside the magnetic layer 10. In this embodiment, the spiral wiring 21 is in direct contact with the first and second columnar wirings 31, 32, and the first columnar wiring 31 is in direct contact with the first external terminal 41, while the second columnar wiring 32 is in direct contact with the second external terminal 42. Therefore, the absence of a via conductor having a smaller cross-sectional area than the first and second columnar wirings 31, 32 enables a reduction in height of the inductor component 1, a reduction in Rdc, and an improvement in connection reliability. However, the spiral wiring 21 may be connected to the first and second columnar wirings 31, 32 through via conductors having a smaller cross-sectional area than the first and second columnar wirings 31, 32.

The external terminals 41, 42 are made of a conductive material and has, for example, a three-layer configuration with Cu excellent in low electric resistance and stress resistance, Ni excellent in corrosion resistance, and Au excellent in solder wettability and reliability arranged in this order from the inside to the outside.

The first external terminal 41 is disposed on the upper surface of the first magnetic layer 11 and covers an end surface of the first columnar wiring 31 exposed from the upper surface. The second external terminal 42 is disposed on the upper surface of the first magnetic layer 11 and covers an end surface of the second columnar wiring 32 exposed from the upper surface.

Preferably, a rust prevention treatment is applied to the external terminals 41, 42. This rust prevention treatment refers to coating with Ni and Au or Ni and Sn etc. This enables the suppression of copper leaching due to solder and the rusting so that the inductor component 1 with high mounting reliability can be provided.

The coating film 50 is made of an insulating material and covers the upper surface of the first magnetic layer 11 and a lower surface of the second magnetic layer 12 to expose the end surfaces of the columnar wirings 31, 32 and the external terminals 41, 42. With the coating film 50, the insulation of the surface of the inductor component 1 can be ensured. The coating film 50 may not be formed on the lower surface side of the second magnetic layer 12.

According to the inductor component 1, since the spiral wiring 21 is formed on the first principal surface 15*a* of the insulating layer 15, the spiral wiring 21 is protected against a processing process of substrate removal (etching, polishing, etc.) from the second principal surface 15*b* side (lower side) of the insulating layer 15. This enables suppression of an increase in DC resistance (Rdc) and variations in Rdc during mass production.

Additionally, since the magnetic layer 10 is in contact with the spiral wiring 21, the insulating layer 15 accounts for a less proportion of the entire inductor component 1, so that the formation region can be ensured for the spiral wiring 21 and the magnetic layer 10. This enables an improvement in trade-off relationship between inductance (L) and Rdc.

Therefore, the inductor component 1 suitably reduced in size and height can be implemented.

Since the insulating layer 15 contains no magnetic substance, or particularly, no magnetic substance powder, the principal surfaces 15*a*, 15*b* of the insulating layer 15 can be improved in flatness and insulation. Therefore, the spiral wiring 21 can be prevented from deteriorating in formation accuracy, insulation, and voltage resistance.

Since the columnar wirings 31, 32 penetrating the inside of the magnetic layer 10 are included, wirings are directly led out from the spiral wiring 21 in the Z direction. This means that the spiral wiring 21 is led out through the shortest distance to the upper surface side of the inductor component and means that unnecessary routing of wiring can be reduced in three-dimensional mounting in which a substrate wiring is connected from the upper surface side of the inductor component 1. Thus, the inductor component 1 has a configuration sufficiently adaptable to the three-dimensional mounting and can improve a degree of freedom in circuit design.

Additionally, the inductor component 1 has no wiring led out in a direction toward a side surface from the spiral wiring 21 and therefore can achieve a reduction in the area of the inductor component 1 viewed in the Z direction, i.e., in the mounting area. Thus, the inductor component 1 can achieve a reduction in the mounting area required for both the surface mounting and the three-dimensional mounting and can improve the degree of freedom in circuit design.

Additionally, the inductor component 1 has the columnar wirings 31, penetrating the inside of the magnetic layer 10 and extending in the normal direction relative to the plane of the wound spiral wiring 21. In this case, a current flows through the columnar wirings 31, 32 in the Z direction rather than the direction along the plane of the wound spiral wiring 21.

When the inductor component 1 is reduced in size, the magnetic layer 10 becomes relatively smaller and, particularly, the inner magnetic path part 13 is increased in magnetic flux density and more easily reaches the magnetic saturation. However, the magnetic flux caused by the Z-direction current flowing through the columnar wirings 31, 32 does not pass through the inner magnetic path part 13, so that the influence on magnetic saturation characteristics, i.e., DC superimposition characteristics, can be reduced. In contrast, when a wiring is led out by a lead-out part from a spiral wiring toward a side surface (the side in the direction along the plane of the wound spiral wiring) as in conventional techniques, a portion of the magnetic flux generated by the current flowing through the lead-out part must pass through the inner magnetic path part and the outer magnetic path part, so that the magnetic saturation characteristics or DC superimposition characteristics are inevitably affected.

Since the columnar wirings 31, 32 penetrate the inside of the first magnetic layer 11, opening portions of the magnetic layer 10 can be made small when the wirings are led out from the spiral wiring 21, and a closed magnetic path structure can easily be achieved. As a result, noise propagation toward the substrate can be suppressed.

Furthermore, since the spiral wiring 21 is wound on a plane along the insulating layer 15, the large inner magnetic path part 13 can be ensured regardless of thinning, so that the thin inductor component 1 having high magnetic saturation characteristics can be provided. In contrast, for example, if an inductor component having a spiral wiring wound perpendicularly to the plane along the insulating layer 15 is used, the area of the coil diameter (the magnetic layer) decreases due to further thinning of the inductor component, i.e., the thinning in the thickness direction of the substrate. As a result, the magnetic saturation characteristics deteriorate, making it impossible to sufficiently energize the inductor.

Furthermore, as shown in FIG. 2, the inductor component 1 includes the coating film 50 covering the surface of the first magnetic layer 11 or the second magnetic layer 12 while exposing the end surfaces of the columnar wirings 31, 32. It is noted that the "exposing" includes not only exposing to the outside of the inductor component 1 but also exposing to another member.

Specifically, on the upper surface of the first magnetic layer 11, the coating film 50 covers a region excluding the external terminals 41, 42. In this way, the end surfaces of the columnar wirings 31, 32 connected to the external terminals 41, 42 are exposed from the coating film 50. Therefore, insulation can reliably be achieved between the adjacent external terminals 41, 42 (the columnar wirings 31, 32). As a result, the voltage resistance and the environmental resistance can be ensured in the inductor component 1. Since the regions of formation of the external terminals 41, 42 formed on the surface of the magnetic layer 10 can arbitrarily be set in accordance with the shape of the coating film 50, a degree of freedom can be increased at the time of mounting, and the external terminals 41, 42 can easily be formed.

In the inductor component 1, as shown in FIG. 2, the surfaces of the external terminals 41, 42 are located on the outer side in the Z direction than the surface of the first magnetic layer 11. Specifically, the external terminals 41, 42 are embedded in the coating film 50, and the surfaces of the external terminals 41, 42 are not flush with the surface of the first magnetic layer 11. In this case, a positional relationship can independently be set between the surface of the magnetic layer 10 and the surfaces of the external terminals 41, 42, so that a degree of freedom can be increased in the thickness of the external terminals 41, 42. According to this configuration, the height positions of the surfaces of the external terminals 41, 42 can be adjusted in the inductor component 1 and, for example, when the inductor component 1 is embedded in the substrate, the height positions can be made coincident with those of external terminals of another embedded component. Therefore, by using the inductor component 1, a laser focusing process can be rationalized at the time of via formation in the substrate, so that the manufacturing efficiency of the substrate can be improved.

Furthermore, in the inductor component 1, as shown in FIG. 1, the areas of the external terminals 41, 42 covering the end surfaces of the columnar wirings 31, 32 are larger than the areas of the columnar wirings 31, 32 when viewed in the Z direction. Therefore, the bonding area at the time of mounting becomes larger, and the inductor component 1 is improved in the mounting reliability. Additionally, an alignment margin can be ensured for a bonding position between the substrate wiring and the inductor component 1 at the time of mounting on the substrate, so that the mounting reliability can be enhanced. In this case, since the mounting reliability can be improved regardless of the volume of the columnar wirings 31, 32, the cross-sectional areas of the columnar wirings 31, 32 viewed in the Z direction can be made smaller to suppress a reduction in volume of the first magnetic layer 11 and to restrain the characteristics of the inductor component 1 from degrading.

The spiral wiring 21, the columnar wirings 31, 32, and the external terminals 41, 42 are preferably conductors made of copper or a copper compound. This enables provision of the inexpensive inductor component 1 capable of reducing the DC resistance. By using copper as a main component, improvements can also be achieved in the bonding force and conductivity for the spiral wiring 21, the columnar wirings 31, 32, and the external terminals 41, 42.

A columnar wiring may be disposed such that the wiring is led out from the spiral wiring to the lower surface of the inductor component. In this case, an external terminal connected to the columnar wiring may be disposed on the lower surface of the inductor component.

Although the inductor component 1 has one spiral wiring, the present disclosure is not limited to this configuration, and the inductor component 1 may include two or more spiral wirings wound on the same plane. since the inductor component 1 has a higher degree of freedom in formation of the external terminals 41, 42, the effect thereof becomes more remarkable in an inductor component having a larger number of external terminals.

Although the spiral wiring is a curve (two-dimensional curve) formed in a plane and having the number of turns exceeding one, the spiral wiring may be a curve having the number of turns less than one or may have a portion that is a straight line.

(Manufacturing Method)

A manufacturing method of the inductor component 1 will be described.

Figure 3A:
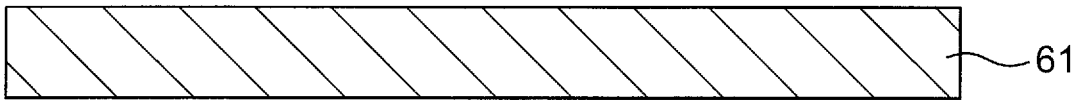
FIG. 3A is an explanatory view for explaining a manufacturing method of the inductor component according to the first embodiment.

A substrate 61 is prepared as shown in FIG. 3A. The substrate 61 is a flat plate-shaped substrate made of, for example, a ceramic material such as glass and ferrite or a printed circuit board material such as a resin including glass cloth. Since the thickness of the substrate 61 does not affect the thickness of the inductor component, the substrate with easy-to-handle thickness may appropriately be used for the reason of warpage due to processing etc.

Figure 3B:
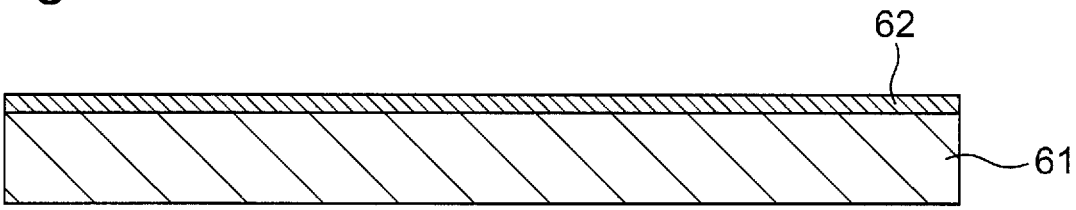
FIG. 3B is an explanatory view for explaining a manufacturing method of an inductor component according to the first embodiment.

As shown in FIG. 3B, the insulating layer 62 containing no magnetic substance is formed on the substrate 61. The insulating layer 62 is made of, for example, a polyimide resin containing no magnetic substance and is formed by coating with the polyimide resin on the upper surface (the first principal surface) of the substrate 61 by printing, application, etc. The insulating layer 62 may be formed as a thin film of an inorganic material such as a silicon oxide film by a dry process such as vapor deposition, sputtering, and CVD on the upper surface of the substrate 61, for example.

Figure 3C:
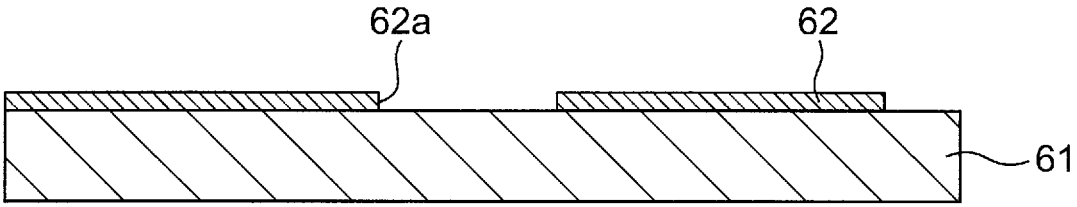
FIG. 3C is an explanatory view for explaining a manufacturing method of an inductor component according to the first embodiment.
Figure 3D:
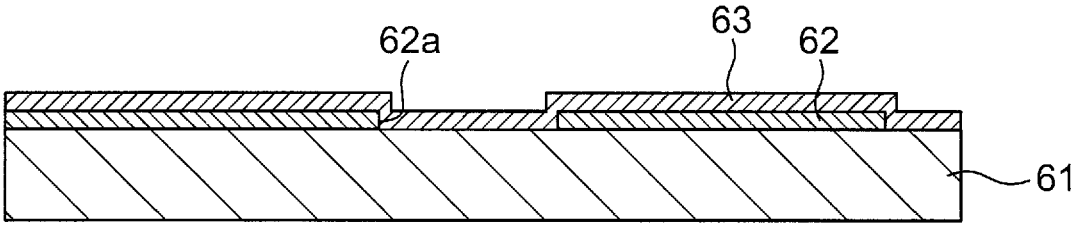
FIG. 3D is an explanatory view for explaining a manufacturing method of an inductor component according to the first embodiment.

As shown in FIG. 3C, the insulating layer 62 is patterned by photolithography to leave a region for forming the spiral wiring. Specifically, the insulating layer 62 is removed while leaving a portion along the spiral wiring. The insulating layer 62 is provided with an opening 62*a* through which the substrate 61 is exposed. As shown in FIG. 3D, a seed layer 63 of Cu is formed on the substrate 61 including the insulating layer 62 by sputtering, electroless plating, etc.

Figure 3E:
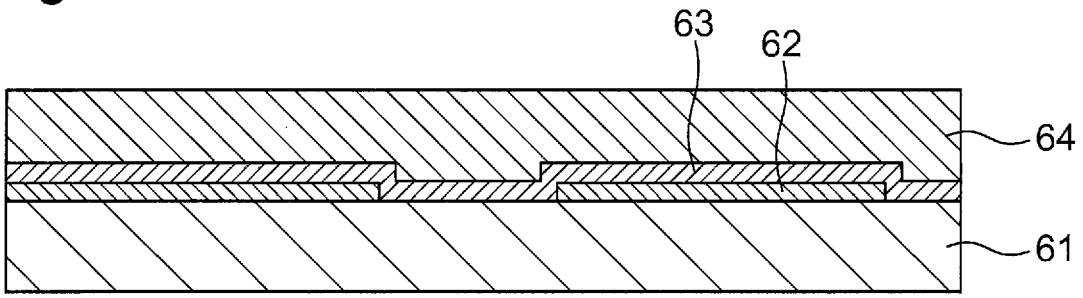
FIG. 3E is an explanatory view for explaining a manufacturing method of an inductor component according to the first embodiment.
Figure 3F:
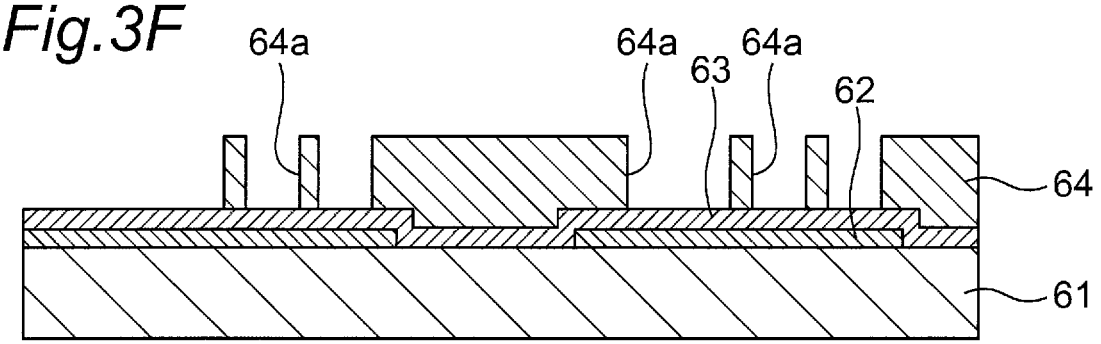
FIG. 3F is an explanatory view for explaining a manufacturing method of an inductor component according to the first embodiment.

As shown in FIG. 3E, a dry film resist (DFR) 64 is affixed to the seed layer 63. As shown in FIG. 3F, the DFR 64 is patterned by photolithography to form a through-hole 64*a* in a region for forming the spiral wiring, so that the seed layer 63 is exposed from the through-hole 64*a*.

Figure 3G:
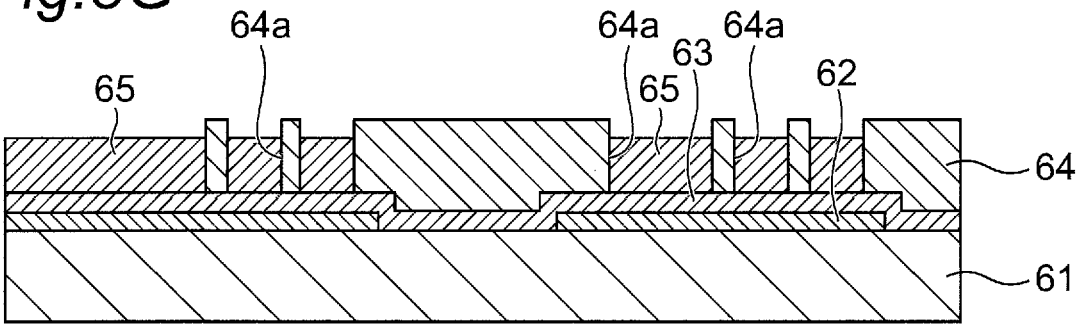
FIG. 3G is an explanatory view for explaining a manufacturing method of an inductor component according to the first embodiment.
Figure 3H:
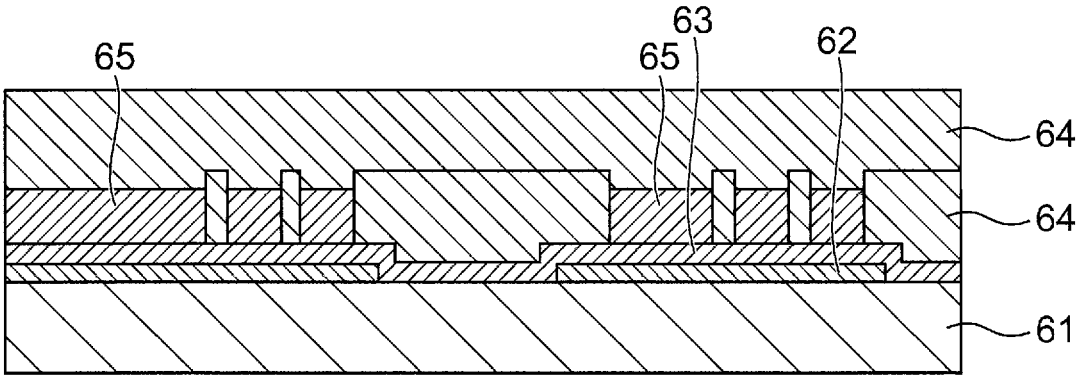
FIG. 3H is an explanatory view for explaining a manufacturing method of an inductor component according to the first embodiment.

As shown in FIG. 3G, a metal film 65 is formed on the seed layer 63 in the through-hole 64*a* by electroplating. As shown in FIG. 3H, after formation of the metal film 65, the DFR 64 is further affixed.

Figure 3I:
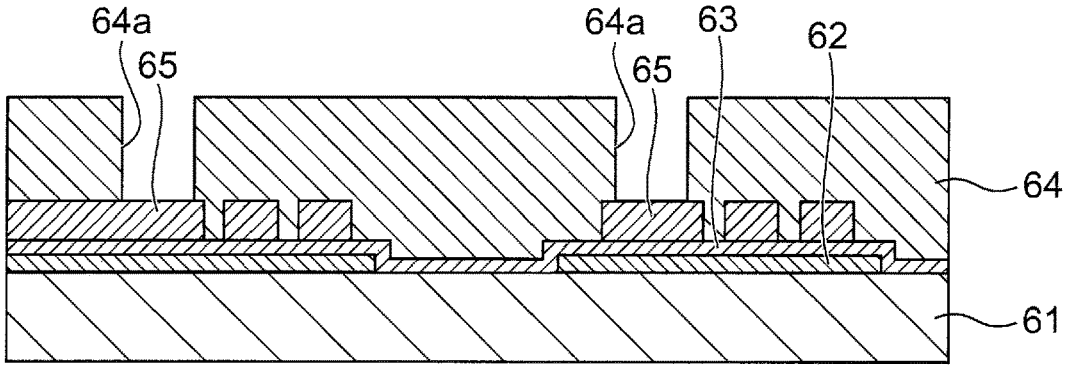
FIG. 3I is an explanatory view for explaining a manufacturing method of an inductor component according to the first embodiment.
Figure 3J:
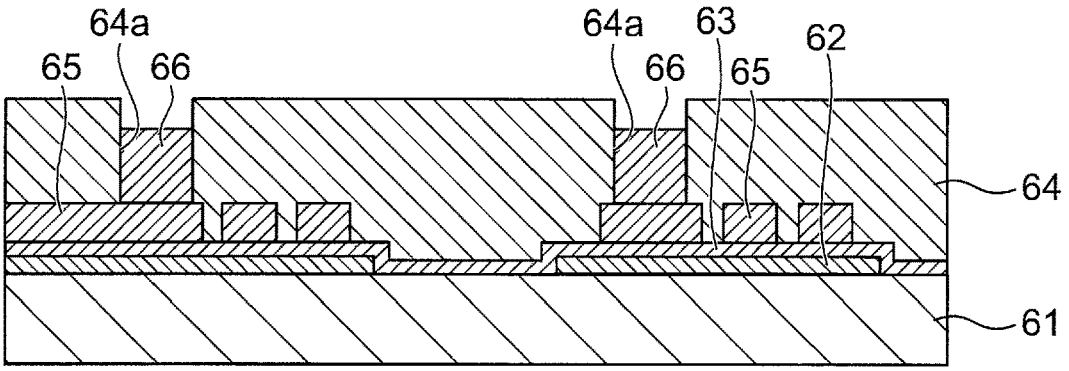
FIG. 3J is an explanatory view for explaining a manufacturing method of an inductor component according to the first embodiment.

As shown in FIG. 3I, the DFR 64 is patterned by photolithography, and the through-hole 64*a* is formed in a region for forming the columnar wiring, so that the metal film 65 is exposed from the through-hole 64*a*. As shown in FIG. 3J, a metal film 66 is further formed by electrolytic plating on the metal film 65 in the through-hole 64*a*.

Figure 3K:
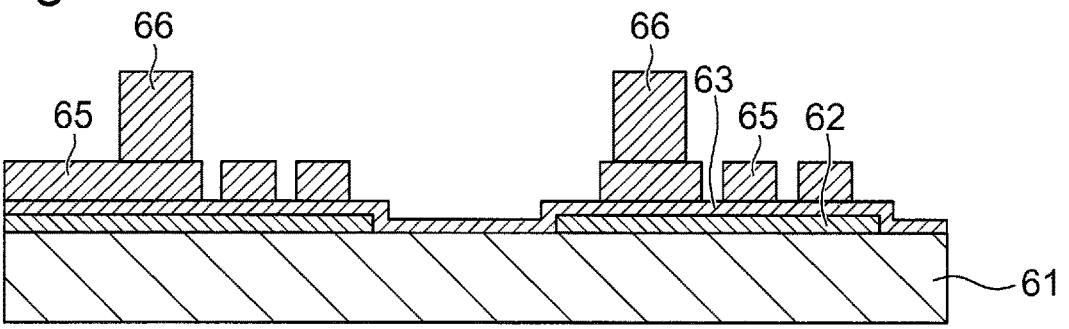
FIG. 3K is an explanatory view for explaining a manufacturing method of an inductor component according to the first embodiment.
Figure 3L:
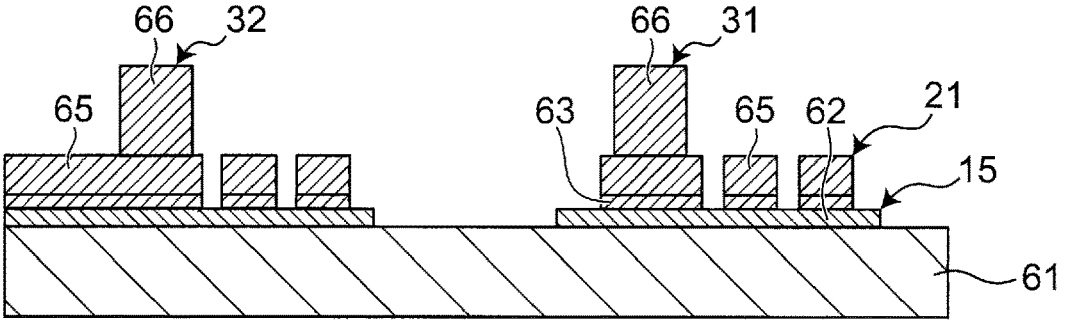
FIG. 3L is an explanatory view for explaining a manufacturing method of an inductor component according to the first embodiment.

As shown in FIG. 3K, the DFR 64 is removed, and as shown in FIG. 3L, the seed layer 63 is removed by etching in an exposed portion on which the metal film 65 is not formed. As a result, the spiral wiring 21 is formed on the first principal surface such that the spiral wiring is wound on the upper surface (the first principal surface) of the insulating layer 62, and the columnar wirings 31, 32 are formed as wirings extending from the spiral wiring 21 in the normal direction of the first principal surface. Therefore, the columnar wirings 31, 32 are formed after formation of the spiral wiring 21 and before formation of the magnetic layer.

Figure 3M:
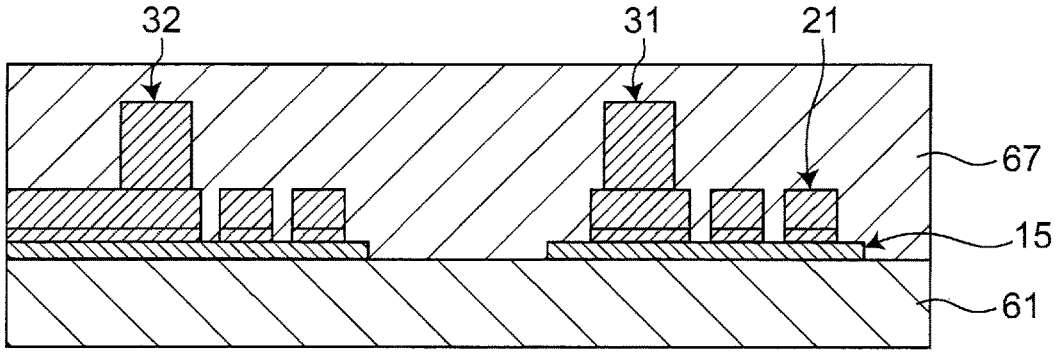
FIG. 3M is an explanatory view for explaining a manufacturing method of an inductor component according to the first embodiment.

As shown in FIG. 3M, a magnetic sheet 67 made of a magnetic material is pressure-bonded to the upper-surface side (spiral wiring formation side) of the substrate 61. As a result, the magnetic layer 10 is formed on the insulating layer 15 in contact with at least a portion of the spiral wiring 21 (the side surface of the spiral wiring 21 and the upper surface of the spiral wiring 21 except the portions in contact with the columnar wiring 31, 32).

Figure 3N:
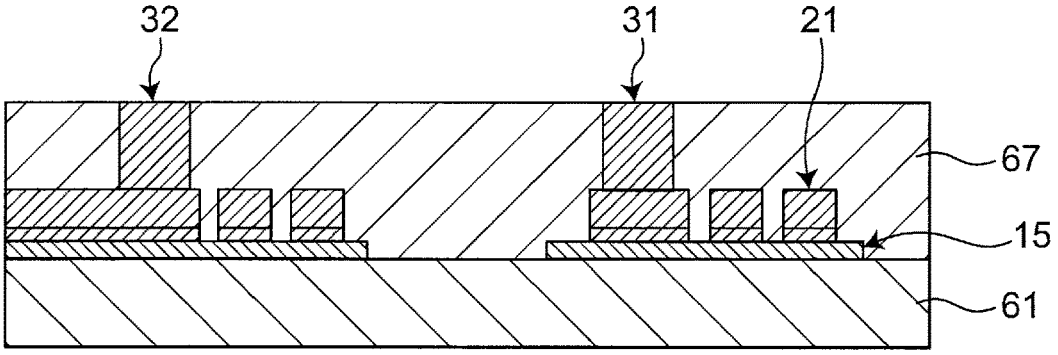
FIG. 3N is an explanatory view for explaining a manufacturing method of an inductor component according to the first embodiment.
Figure 3O:
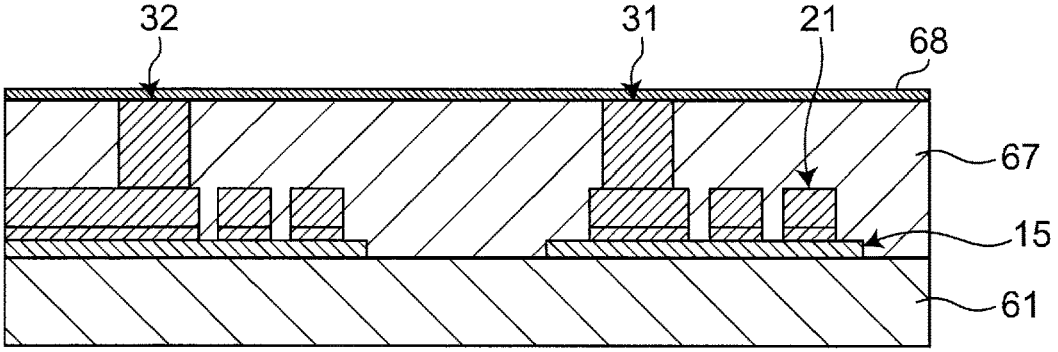
FIG. 3O is an explanatory view for explaining a manufacturing method of an inductor component according to the first embodiment.

As shown in FIG. 3N, the magnetic sheet 67 is polished to expose the upper ends of the columnar wirings 31, 32 (the metal film 66). As shown in FIG. 3O, a solder resist (SR) 68 is formed as the coating film 50 on the upper surface (the first principal surface) of the magnetic sheet 67.

Figure 3P:
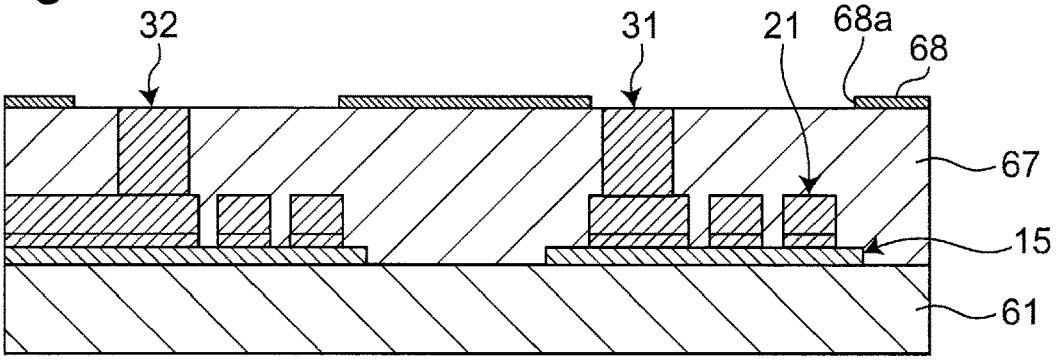
FIG. 3P is an explanatory view for explaining a manufacturing method of an inductor component according to the first embodiment.

As shown in FIG. 3P, the SR 68 is patterned by photolithography to form through-holes 68*a* through which the columnar wirings 31, 32 (the metal film 66) and the magnetic layer 10 (the magnetic sheet 67) are exposed, in a region for forming external terminals.

Figure 3Q:
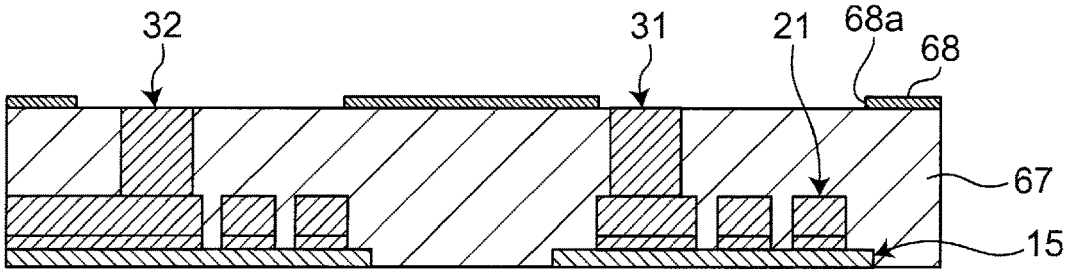
FIG. 3Q is an explanatory view for explaining a manufacturing method of an inductor component according to the first embodiment.
Figure 3R:
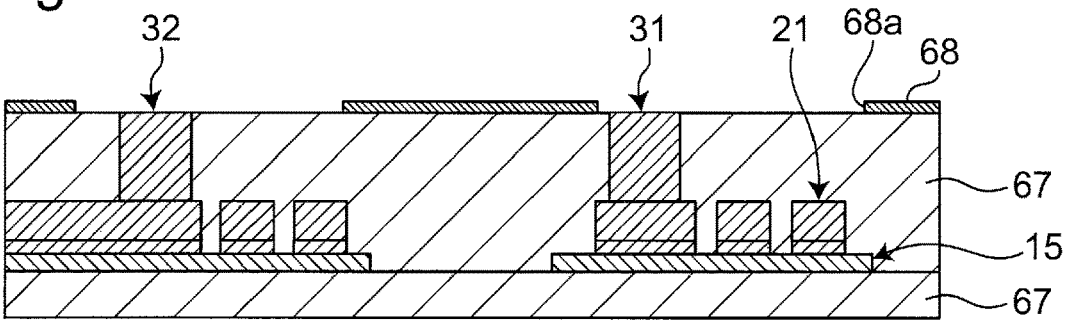
FIG. 3R is an explanatory view for explaining a manufacturing method of an inductor component according to the first embodiment.

As shown in FIG. 3Q, the substrate 61 is removed by polishing. As shown in FIG. 3R, the magnetic sheet 67 made of a magnetic material is pressure-bonded to the removal side of the substrate 61 and polished to an appropriate thickness.

Figure 3S:
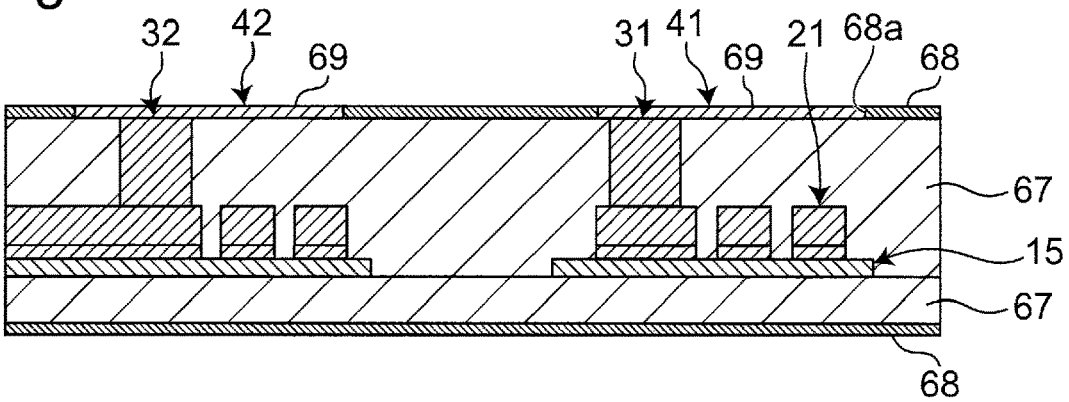
FIG. 3S is an explanatory view for explaining a manufacturing method of an inductor component according to the first embodiment.
Figure 3T:
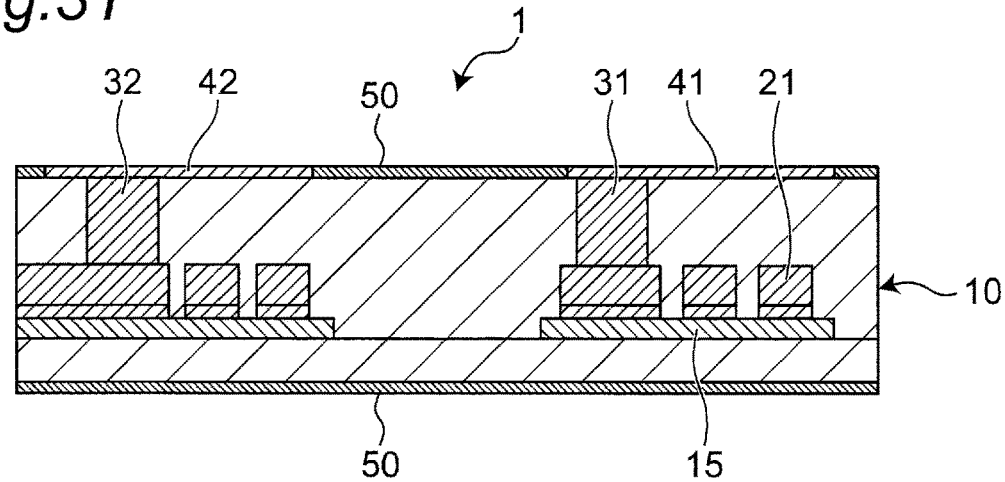
FIG. 3T is an explanatory view for explaining a manufacturing method of an inductor component according to the first embodiment.

As shown in FIG. 3S, a metal film 69 of Cu/Ni/Au is formed by electroless plating and grown from the columnar wirings 31, 32 (the metal film 66) into the through-holes 68*a* of the SR 68. The metal film 69 forms the first external terminal 41 connected to the first columnar wiring 31 and the second external terminal 42 connected to the second columnar wiring 32. The SR 68 is formed as the coating film 50 on the lower surface on the side opposite to the external terminals 41, 42. As shown in FIG. 3T, individual pieces are formed and subjected to barrel polishing as needed, and burrs are removed to manufacture the inductor component 1.

According to the method of manufacturing the inductor component 1, when the substrate 61 is removed, the spiral wiring 21 is protected by the insulating layer 15, so that an increase in Rdc and variations in Rdc during mass production can be suppressed. Since the magnetic layer 10 is in contact with the spiral wiring 21, the insulating layer 15 accounts for a less proportion of the entire inductor component 1, so that the trade-off relationship between L and Rdc can be improved. Therefore, the inductor component 1 suitably reduced in size and height can be manufactured.

Since the insulating layer 15 is removed while leaving a portion along the spiral wiring 21, the proportion of the insulating layer is further reduced.

Since the columnar wirings 31, 32 extending from the spiral wiring 21 are formed and the magnetic layer 10 is formed such that the upper ends of the columnar wirings 31, 32 are exposed, the absence of a via conductor enables a reduction in height of the inductor component 1, a reduction in Rdc, and an improvement in connection reliability.

The method of manufacturing the inductor component 1 is merely an example, and construction techniques and materials used in steps may appropriately be replaced with other well-known techniques and materials. For example, although the insulating layer 62, the DFR 64, and the SR 68 are patterned after coating in the above description, the insulating layer 62 may directly be formed on necessary portions by application, printing, mask vapor deposition, lift-off, etc. Although polishing is used for removal of the substrate 61 and thinning of the magnetic sheet 67, another physical process such as blasting and laser or a chemical process such as hydrofluoric acid treatment may be used.

Example

An example of the inductor component 1 will be described.

The spiral wiring 21, the columnar wirings 31, 32, and the external terminals 41, 42 are made of low resistance metal such as Cu, Ag, and Au, for example. Preferably, the spiral wiring 21 with a low resistance and a narrow pitch can inexpensively be formed by using copper plating formed by SAP (semi additive process). The spiral wiring 21, the columnar wirings 31, 32, and the external terminals 41, 42 may be formed by a plating method other than SAP, a sputtering method, a vapor deposition method, an application method, etc.

In this example, the spiral wiring 21 and the columnar wirings 31, 32 are formed by copper plating with SAP, and the external terminals 41, 42 are formed by electroless Cu plating. The spiral wiring 21, the columnar wirings 31, 32, and the external terminals 41, 42 may all be formed by the same construction technique.

The magnetic layer 10 (the first magnetic layer 11, the second magnetic layer 12, the inner magnetic path part 13, and the outer magnetic path part 14) is made of a resin containing a powder of a magnetic material, for example, and preferably contains a substantially spherical metal magnetic material. Therefore, the filling property of the magnetic material in the magnetic paths can be made favorable. As a result, the magnetic paths can be made smaller to provide the small-sized inductor component 1. However, the magnetic layer may be made of a resin containing a powder of a magnetic material such as ferrite or may be formed by sintering a ferrite substrate or a green sheet of a magnetic material.

In this example, the resin constituting the magnetic layer 10 is an organic insulating material made of an epoxy resin, bismaleimide, liquid crystal polymer, or polyimide, for example. The magnetic material powder of the magnetic layer 10 is a metal magnetic substance having an average particle diameter of 5 μm or less. The metal magnetic substance is, for example, an FeSi alloy such as FeSiCr, an FeCo alloy, an Fe alloy such as NiFe, or an amorphous alloy thereof. The content percentage of the magnetic material is preferably 50 vol % or more and 85 vol % or less (i.e., from 50 vol % to 85 vol %) relative to the whole magnetic layer 10.

By using a magnetic material having a small particle diameter such as an average particle diameter of 5 μm or less as described above, an eddy current generated in a metal magnetic substance can be suppressed so as to provide the inductor component 1 with a smaller loss even at a high frequency such as tens of MHz.

By using an Fe-based magnetic material, larger magnetic saturation characteristics can be acquired as compared to ferrite etc.

By setting a filling amount of the magnetic material to 50 vol % or more, the magnetic permeability can be increased and the number of turns of a spiral wiring required for acquiring a desired inductance value can be reduced so as to decrease loss at high frequency due to a direct-current resistance and a proximity effect. Furthermore, when the filling amount is 85 vol % or less, since the volume of the organic insulating resin is sufficiently large with respect to the magnetic material and the flowability of the magnetic material can be ensured, the filling property is improved so that the effective magnetic permeability and the strength of the magnetic material itself can be increased.

On the other hand, when used at low frequency, it is not necessary to be concerned about the eddy current loss as compared to the case of high frequency, so that the average particle diameter of the metal magnetic substance may be increased to make the magnetic permeability higher. For example, a magnetic material preferably has large particles with an average particle diameter of 100 to 30 μm mixed with some small particles (10 μm or less) to fill gaps between the large particles. This can make the filling amount higher to implement a magnetic material with high magnetic permeability at a frequency such as 1 to 10 MHz. However, at a frequency of 1 MHz or more, the relative magnetic permeability is preferably 70 or less for suppression of influence of the eddy current loss.

In this example, the coating film 50 is formed of a photosensitive resist or a solder resist made of an organic insulating resin such as polyimide, phenol, an epoxy resin, etc. The rust prevention treatment applied to the surfaces of the external terminals 41, 42 is plating of Ni, Au, Sn, etc.

The insulating layer 15 is made of an insulating resin containing contain no magnetic substance, or particularly no magnetic substance powder. Therefore, for example, since no magnetic material having a particle diameter of 5 μm is contained, the principal surfaces 15*a*, 15*b* of the insulating layer 15 can be improved in flatness and insulation. Therefore, the spiral wiring 21 can be prevented from deteriorating in formation accuracy, insulation, and voltage resistance. Additionally, since the spiral wiring 21 is not covered with the insulating layer 15, the volume of the magnetic material increases on the assumption that the same chip size is the same, and therefore, the inductance value can be made higher. The thickness of the insulating layer 15 is preferably smaller than the spiral wiring 21, and the thickness of the insulating layer 15 is preferably 10 μm or less.

In this example, the spiral wiring 21 has the thickness of 45 μm, the wiring width of 40 μm, and the inter-wiring space of 10 μm.

The inter-wiring space is preferably 3 μm or more and 20 μm or less (i.e., from 3 μm to 20 μm). Since the wiring width can be increased by setting the inter-wiring space to 20 μm or less, the DC resistance can be lowered. By setting the inter-wiring space to 3 μm or more, sufficient insulation can be kept between the wirings.

The wiring thickness is preferably 40 μm or more and 120 μm or less (i.e., from 40 μm to 120 μm). By setting the wiring thickness to 40 μm or more, the DC resistance can sufficiently be lowered. By setting the wiring thickness to 120 μm or less, a wiring aspect is prevented from becoming extremely large, and process variations can be suppressed.

In this embodiment, the number of turns of the spiral wiring 21 is 2.5. The number of turns is preferably five or less. If the number of turns is five or less, the loss of the proximity effect can be reduced for a high-frequency switching operation such as from 50 MHz to 150 MHz. On the other hand, in the case of use in a low frequency switching operation at 1 MHz etc., the number of turns is preferably 2.5 or more. By increasing the number of turns, the inductance can be made higher to reduce an inductor ripple current.

In this embodiment, the thickness of the first magnetic layer 11 is 117.5 μm, and the thickness of the second magnetic layer 12 is 67.5 μm. The first magnetic layer 11 and the second magnetic layer 12 preferably each have a thickness of 10 μm or more and 200 μm or less (i.e., from 10 μm to 200 μm). If the thickness of the first and second magnetic layers 11, 12 is too small, the spiral wiring 21 may be exposed due to process variations during grinding of the first and second magnetic layers 11, 12. If the thickness of the first and second magnetic layers 11, 12 is small with respect to the average particle diameter of the magnetic material contained in the first and second magnetic layers 11, 12, the effective magnetic permeability is significantly reduced due to shedding of particles. By setting the thickness of the first and second magnetic layers 11, 12 to 200 μm or less, the inductor component can be formed into a thin film.

The thickness of the first magnetic layer 11 is preferably greater than the thickness of the second magnetic layer 12. The inductor component 1 has the first magnetic layer 11 larger than the second magnetic layer 12 in terms of the area of the external terminals 41, 42 viewed in the normal direction (Z direction). Therefore, in the inductor component 1, the magnetic flux in the first magnetic layer 11 is more likely to be blocked by the external terminals 41, 42 as compared to the magnetic flux in the second magnetic layer 12. Thus, by increasing the thickness on the first magnetic layer 11 side to place a distance from the external terminals 41, 42 and reduce the influence of the external terminals 41, 42, the sensitivity of the inductance to variations in the magnetic layer thickness (chip thickness) can be reduced, and the inductor component having inductance with narrow deviation can be provided. In general, on the first magnetic layer 11 side having a larger area of the external terminals 41, 42, an area of a land pattern is larger on the board side on which the inductor component 1 is mounted/incorporated, and the number of surrounding electronic components also tends to be larger. Therefore, by increasing the thickness of the first magnetic layer 11 to reduce a magnetic flux leakage, the adverse effects due to the magnetic flux leakage can effectively be reduced in terms of eddy current loss due to the land pattern, noise made incident on surrounding electronic components, etc.

The thickness of the external terminals 41, 42 including the rust prevention treatment is made up of the electroless copper plating thickness of 5 μm, the Ni plating thickness of 5 μm, and the Au plating thickness of 0.1 μm. The thickness of the coating film 50 is 5 μm. For these thicknesses, a thickness and a size may appropriately be selected from the viewpoint of chip thickness and mounting reliability as well.

From the above, according to this example, the thin inductor having the chip size of 1210 (1.2 mm×1.0 mm) and the thickness of 0.300 mm can be provided.

Second Embodiment

Figure 4:
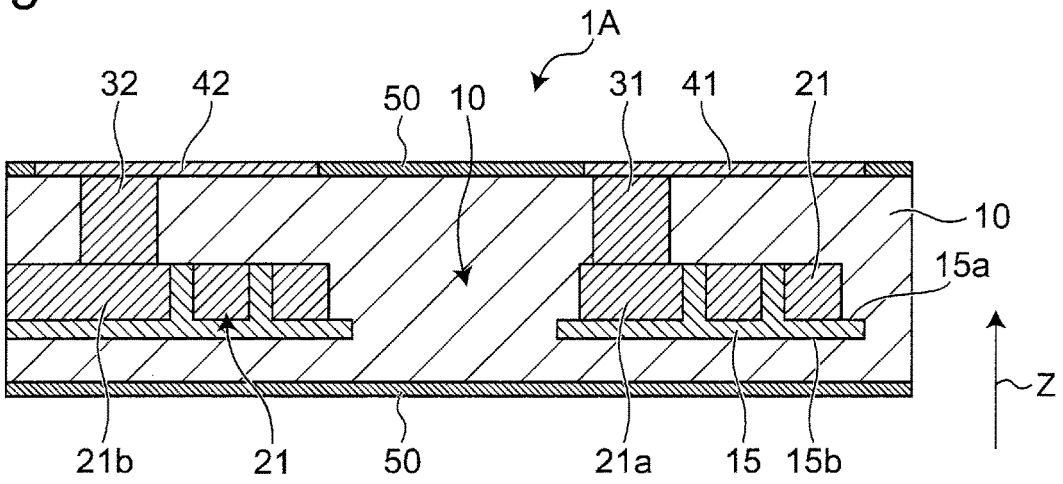
FIG. 4 is a cross-sectional view of an inductor component according to a second embodiment.

FIG. 4 is a cross-sectional view of a second embodiment of an inductor component. The second embodiment is different from the first embodiment in arrangement of the insulating layer. This different configuration will hereinafter be described. The other constituent elements have the same configuration as the first embodiment and are denoted by the same reference numerals as the first embodiment and will not be described.

As shown in FIG. 4, an inductor component 1A of the second embodiment has the spiral wiring 21 formed in a spiral shape exceeding one round. The side surface of the spiral wiring 21 is covered with the insulating layer 15 in a region where wirings run parallel to each other due to the spiral wiring 21 exceeding one round. In other words, the insulating layer 15 covers the lower surface of the spiral wiring 21 as in the first embodiment and further exists between the wirings of the spiral wiring 21 in the region exceeding one round. The thickness of the insulating layer 15 present between the wirings of the spiral wiring 21 may be the same as the wiring thickness of the spiral wiring 21 or may be larger or smaller than the wiring thickness of the spiral wiring 21.

This enables elimination of a possibility of formation of an electrical short-circuit path through a magnetic material such as a metal magnetic substance between the wirings of the spiral wiring 21 when a space is narrow between the wirings of the spiral wiring 21. Therefore, the spiral wiring 21 can be improved in insulation and voltage resistance, and the highly reliable inductor component 1A can be provided.

In the region where the wirings of the spiral wiring 21 do not run parallel to each other, for example, at both end portions of the spiral wiring 21, an outer side surface of the outermost circumference of the spiral wiring 21, and an inner side surface of the innermost circumference of the spiral wiring 21, the side surface of the spiral wiring 21 may be covered with the insulating layer 15 or may be in direct contact with the magnetic layer 10.

Describing a method of manufacturing the inductor component 1A, for example, the insulating layer 15 may be disposed between the wirings of the spiral wiring 21 after the step of FIG. 3L of the first embodiment.

Third Embodiment

Figure 5:
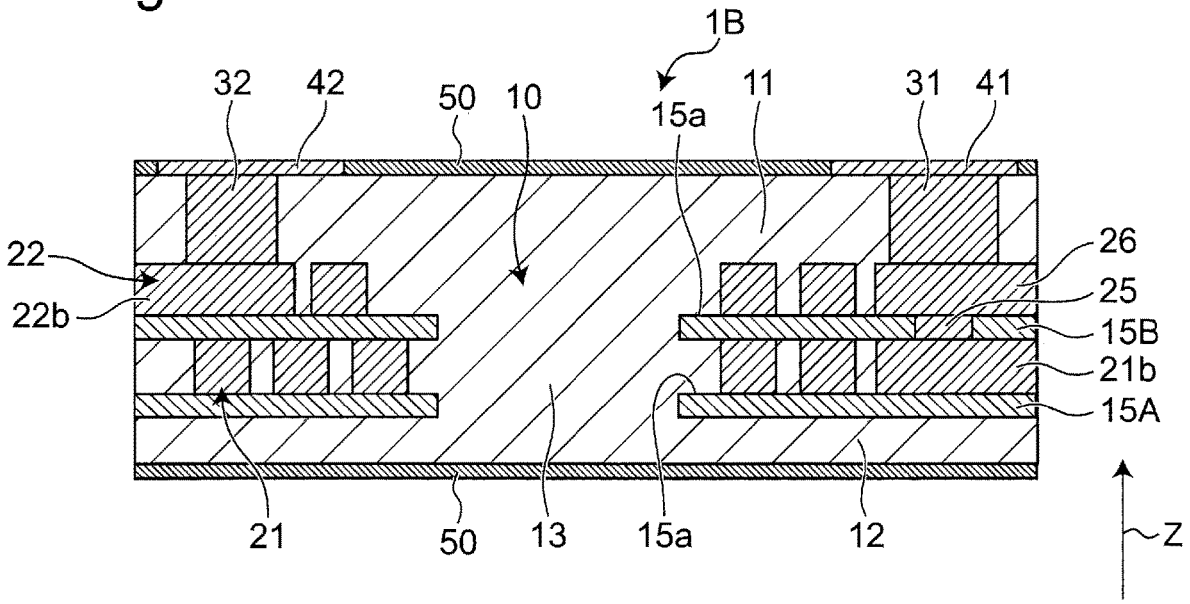
FIG. 5 is a cross-sectional view of an inductor component according to a third embodiment.

FIG. 5 is a cross-sectional view of a third embodiment of an inductor component. The third embodiment is different from the first embodiment in the number of layers of the spiral wiring. This different configuration will hereinafter be described. The other constituent elements have the same configuration as the first embodiment and are denoted by the same reference numerals as the first embodiment and will not be described.

As shown in FIG. 5, similarly to the inductor component 1 of the first embodiment, an inductor component 1B of the second embodiment includes insulating layers 15A, 15B, spiral wirings 21, 22 formed on first principal surfaces 15*a* of the insulating layers 15A, 15B, and the magnetic layer 10 in contact with at least a portion of the spiral wirings 21, 22.

On the other hand, the inductor component 1B has multiple spiral wirings as the first spiral wiring 21 and the second spiral wiring 22 and further includes a via conductor connecting the first spiral wiring 21 and the second spiral wiring 22 in series. The two layers of the spiral wirings 21, 22 are electrically connected in series between the first and second external terminals 41, 42.

Specifically, the second spiral wiring 22 is laminated in the Z direction (upper direction) from the first spiral wiring 21. The first spiral wiring 21 is spirally wound in a counterclockwise direction from the outer circumferential end 21*b* toward the inner circumferential end 21*a* when viewed from the upper side. The second spiral wiring 22 is spirally wound in a counterclockwise direction from an inner circumferential end 22*a* toward an outer circumferential end 22*b* when viewed from the upper side.

The first spiral wiring 21 is formed on the first principal surface 15*a* of the first insulating layer 15A. The second spiral wiring 22 is formed on the first principal surface 15*a* of the second insulating layer 15B. The second insulating layer 15B is laminated in the Z direction (upper direction) from the first insulating layer 15A.

The outer circumferential end 22*b* of the second spiral wiring 22 is connected to the second external terminal 42 through the second columnar wiring 32 on the upper side of the outer circumferential end 22*b*. An inner circumferential end of the second spiral wiring 22 is connected to the inner circumferential end of the first spiral wiring 21 through a via conductor on the lower side of the inner circumferential end. The via conductor penetrates the inside of the second insulating layer 15B in the normal direction of the first principal surface 15*a*.

The outer circumferential end 21*b* of the first spiral wiring 21 is connected to the first external terminal 41 through a via conductor 25, an end portion wiring 26, and the first columnar wiring 31 on the upper side of the outer circumferential end 21*b*. The via conductor 25 penetrates the inside of the second insulating layer 15B in the normal direction of the first principal surface 15*a*. The end portion wiring 26 is formed on the second insulating layer 15B, i.e., on the same plane as the second spiral wiring 22.

Since the inductor component 1B has the first spiral wiring 21 and the second spiral wiring 22 connected in series, the number of turns can be increased to improve the inductance value. Since the first and second columnar wirings 31, 32 can be led out from the outer circumferential ends of the first and second spiral wirings 21, 22, the inner diameters of the first and second spiral wirings 21, 22 can be made large to improve the inductance value.

Since the first spiral wiring 21 and the second spiral wiring 22 are both laminated in the normal direction, the inductor component 1B can be reduced in the area viewed in the Z direction, i.e., the mounting area, with respect to the number of turns, so that the inductor component 1B can be reduced in size.

The spiral wirings are not limited to two layers and may be multiple layers. Additionally, the spiral wiring on the upper layer side is not affected by the processing process of substrate removal (etching, polishing) etc. from the lower side and therefore may be formed on the magnetic layer instead of the insulating layer. Specifically, in the configuration of FIG. 5, the insulating layer 15B may not exist, and the magnetic layer 10 may be disposed instead. As in the second embodiment, the side surface of the spiral wiring 21 may be covered with the insulating layer 15 (the insulating layer 15B) in the region where the wirings of the spiral wiring 21 run parallel to each other. In this case, the first spiral wiring 21 is in contact with the magnetic layer 10 on the side surface on the inner circumferential side.

Describing a method of manufacturing the inductor component 1B, a substrate is prepared; a first insulating layer 15A is formed on the substrate; the first spiral wiring 21 is formed on the first principal surface 15*a* of the first insulating layer 15A; and the magnetic layer 10 is formed in contact with at least a portion of the first spiral wiring 21, or specifically, the side surface of the first spiral wiring 21. Additionally, after the upper surface of the first spiral wiring 21 is exposed by polishing of the magnetic layer 10, etc., the second insulating layer 15B is formed on the first spiral wiring 21 and the magnetic layer 10; the second spiral wiring 22 is formed on the first principal surface 15*a* of the second insulating layer 15B; and the magnetic layer 10 is formed in contact with at least a portion of the second spiral wiring 22. Subsequently, the substrate is removed.

Fourth Embodiment

Figure 6:
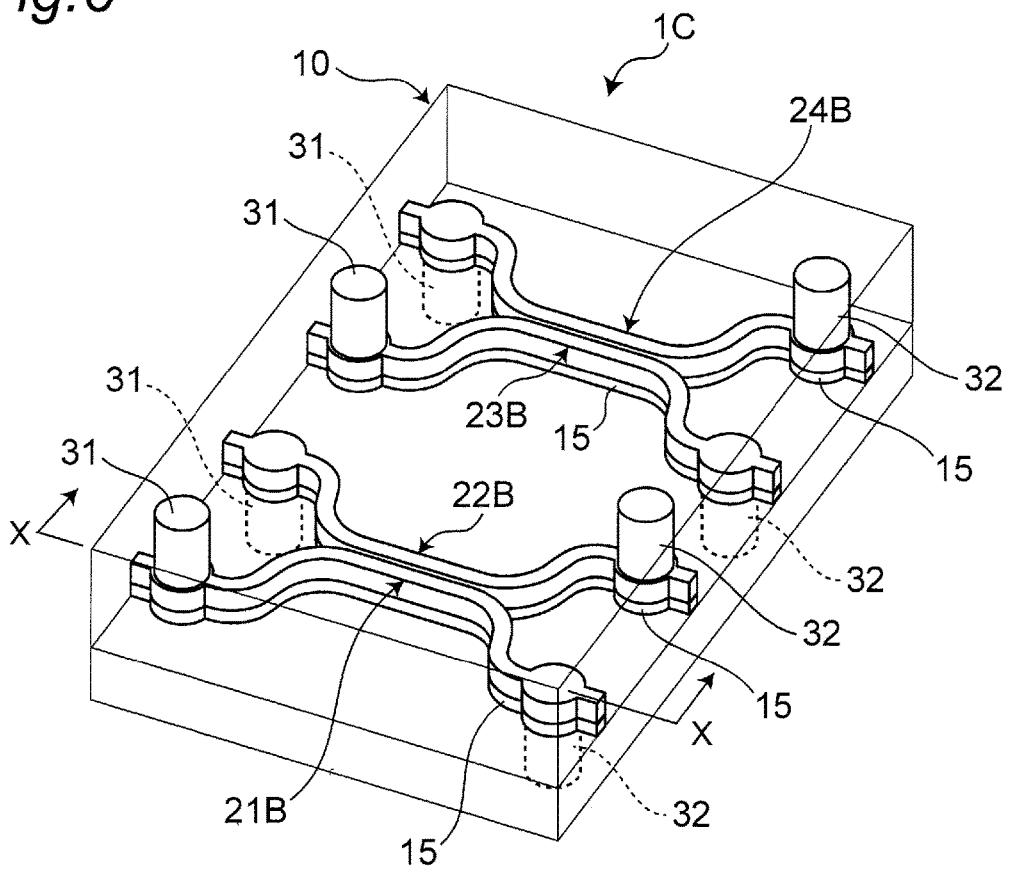
FIG. 6 is a transparent perspective view of an inductor component according to a fourth embodiment.
Figure 7:
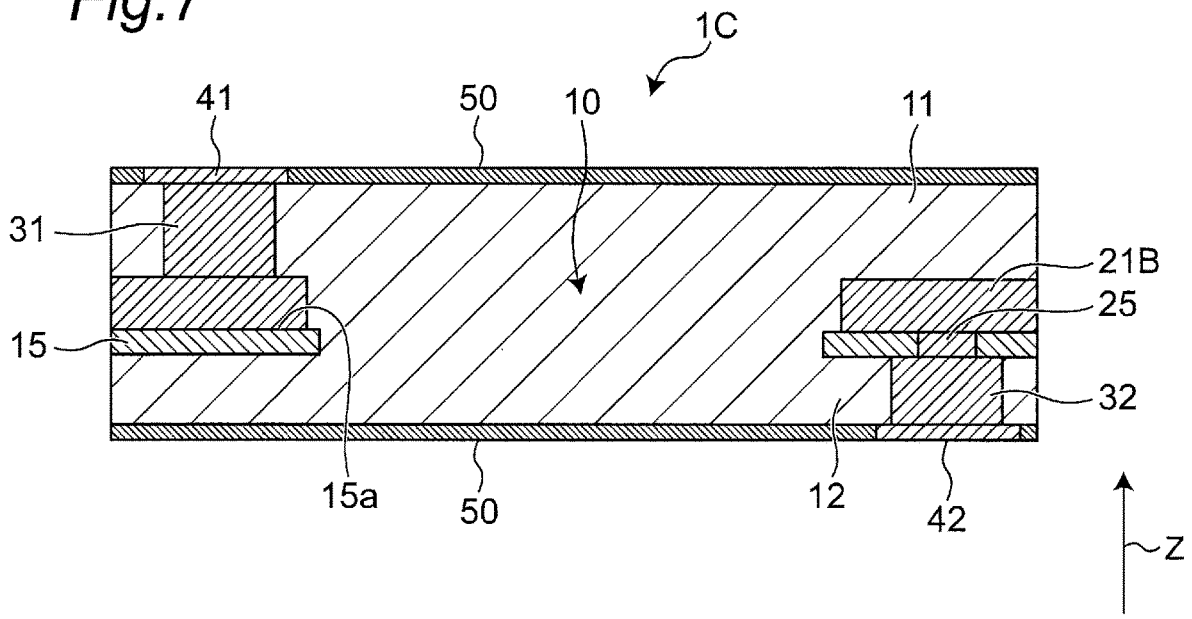
FIG. 7 is a cross-sectional view of the inductor component according to the fourth embodiment.

FIG. 6 is a transparent perspective view of a fourth embodiment of an inductor component. FIG. 7 is a cross-sectional view taken along a line X-X of FIG. 6. The fourth embodiment is different from the first embodiment in the configuration of the spiral wiring. This different configuration will hereinafter be described. In the fourth embodiment, the same constituent elements as the first embodiment are denoted by the same reference numerals as the first embodiment and therefore will not be described.

As shown in FIGS. 6 and 7, similarly to the inductor component 1 of the first embodiment, an inductor component 1C includes the insulating layer 15, spiral wirings 21B to 24B formed on the first principal surface 15*a* of the insulating layer 15, and the magnetic layer 10 in contact with at least a portion of each of the spiral wirings 21B to 24B.

On the other hand, the inductor component 1C has the first spiral wiring 21B, the second spiral wiring 22B, the third spiral wiring 23B, and the fourth spiral wiring 24B each having a semi-elliptical arc shape when viewed in the Z direction. Therefore, each of the first to fourth spiral wirings 21B to 24B is a curved wiring wound around about a half of the circumference. The spiral wirings 21B to 24B each include a linear part in a middle portion. As described above, in this disclosure, a "spiral wiring wound into a planar shape" may be a curve (two-dimensional curve) formed into a planar shape with the number of turns less than one and may have a portion that is a linear part.

The first and fourth spiral wirings 21B, 24B each have both ends connected to the first columnar wiring 31 and the second columnar wiring 32 located on the outer side and have a curved shape drawing an arc from the first columnar wiring 31 and the second columnar wiring 32 toward the center side of the inductor component 1C.

The second and third spiral wirings 22B, 23B each have both ends connected to the first columnar wiring 31 and the second columnar wiring 32 located on the inner side and have a curved shape drawing an arc from the first columnar wiring 31 and the second columnar wiring 32 toward an edge side of the inductor component 1C.

It is assumed that an inner diameter portion of each of the first to fourth spiral wirings 21B to 24B is defined as an area surrounded by the curve drawn by the spiral wirings 21B to 24B and the straight line connecting both ends of the spiral wirings 21B to 24B. In this case, none of the spiral wirings 21B to 24B have the inner diameter portions overlapping with each other when viewed in the Z direction.

On the other hand, the first and second spiral wirings 21B, 22B are close to each other. Therefore, the magnetic flux generated in the first spiral wiring 21B goes around the adjacent second spiral wiring 22B, and the magnetic flux generated in the second spiral wiring 22B goes around the adjacent first spiral wiring 21B. The same applies to the third and fourth spiral wirings 23B, 24B arranged close to each other. Therefore, this strengthens the magnetic coupling between the first spiral wiring 21B and the second spiral wiring 22B and the magnetic coupling between the third spiral wiring 23B and the fourth spiral wiring 24B.

When currents flow simultaneously through the first and second spiral wirings 21B, 22B from the ends on the same side to the other ends on the opposite side, the magnetic fluxes strengthen each other. This means that when the ends on the same side of the first spiral wiring 21B and the second spiral wiring 22B are both used as the input side of pulse signals and the other ends on the opposite side are both used as the output side of the pulse signals, the first spiral wiring 21B and the second spiral wiring 22B are positively coupled. On the other hand, for example, when one of the first spiral wiring 21B and the second spiral wiring 22B has one end side used for input and the other end side used for output while the other spiral wiring has one end side used for output and the other end side used for input, the first spiral wiring 21B and the second spiral wiring 22B can be put into a negatively coupled state. The same applies to the third and fourth spiral wirings 23B, 24B.

The first columnar wirings 31 connected to the one end sides of the first and third spiral wirings 21B, 23B and the second columnar wirings 32 connected to the other end sides of the second and fourth spiral wirings 22B, 24B each penetrate the inside of the first magnetic layer 11 and are exposed on the upper surface. The second columnar wirings 32 connected through via conductors 25 to the other end sides of the first and third spiral wirings 21B, 23B and the first columnar wirings 31 connected through the via conductors 25 to the one end sides of the second and fourth spiral wirings 22B, 24B each penetrate the inside of the second magnetic layer 12 and are exposed on the lower surface. The via conductor 25 penetrate the inside of the insulating layer 15. The first columnar wirings 31 are connected to the first external terminal 41. The second columnar wirings 32 are connected to the second external terminal 42.

According to this configuration, for example, a set of the first and second spiral wirings 21B, 22B and a set of the third and fourth spiral wirings 23B, 24B can each more easily negatively be coupled by embedding the inductor component 1C in a substrate, disposing a pulse signal input line on the upper surface side of the first magnetic layer 11, and disposing a pulse signal output line on the lower surface side of the second magnetic layer 12.

It is noted that the inductor component 1C has wirings further extending toward the outside of the chip from the connecting positions of the spiral wirings 21B to 24B to the columnar wirings 31, 32 and these wirings are those connected to a power feeding wiring when an additional copper electrolytic plating is performed after a copper wiring is formed by SAP. The additional copper electrolytic plating can easily be performed through this power feeding wiring even after the power feeding film of SAP is removed, and an inter-wiring distance can be narrowed. Additionally, by performing the additional copper electrode plating after SAP formation, the inter-wiring distance of the first and second spiral wirings 21B, 22B and the inter-wiring distance of the third and fourth spiral wirings 23B, 24B can be narrowed to achieve high magnetic coupling.

The number of spiral wirings is not limited to four and may be one to three or five or more. Both end portions of the spiral wirings may be connected to the columnar wirings penetrating the magnetic layer on the same side of the magnetic layer, or one end portion may be connected to both the columnar wiring penetrating the magnetic layer on the first principal surface side and the columnar wiring penetrating the magnetic layer on the second principal surface side.

Describing a method of manufacturing the inductor component 1C, a substrate is prepared; the insulating layer 15 is formed on the substrate; the spiral wirings 21B to 24B are formed on the first principal surface 15*a* of the first insulating layer 15, while the first columnar wiring 31 is formed on one end of each of the spiral wirings 21B to 24B; and the magnetic layer 10 is formed in contact with at least a portion of each of the spiral wirings 21B to 24B. Subsequently, the substrate is removed. Additionally, the first insulating layer 15 under the other ends of the spiral wirings 21B to 24B is opened from the second principal surface 15*b* side with a laser drill etc. to form the via conductors 25 and the second columnar wirings 32. The magnetic layer 10 is formed on the second principal surface 15*b* side of the first insulating layer 15; the magnetic layer 10 is polished from the upper side and the lower side to expose the first columnar wirings 31 and the second columnar wirings 32; and after the coating film 50 is formed and opened, the first external terminal 41 and the second external terminal 42 may be formed.

The present disclosure is not limited to the embodiments described above and may be changed in design without departing from the spirit of the present disclosure. For example, respective feature points of the first to fourth embodiments may variously be combined.

The magnetic layer may be in contact only with the side surface of the spiral wiring in the contact portion with the spiral wiring, or the magnetic layer may be in contact only with the upper surface of the spiral wiring in the contact portion with the spiral wiring. Even in these cases, the proportion of the insulating layer can be reduced as compared to the configuration in which the side surface and the top surface of the spiral wiring are covered with the insulating layer.

What is claimed is:

1. An inductor component comprising:

an insulating layer containing no magnetic substance;

a spiral wiring formed on a first principal surface of the insulating layer and wound on the first principal surface;

a magnetic layer in direct contact with at least a portion of the spiral wiring;

a first columnar wiring that extends from the spiral wiring in a normal direction of the first principal surface to a first external terminal formed outside the magnetic layer, the first columnar wiring being in direct contact with the first external terminal and an inner circumferential end of the spiral wiring; and a second columnar wiring that extends from the spiral wiring in the normal direction of the first principal surface to a second external terminal formed outside the magnetic layer, the second columnar wiring being in direct contact with the second external terminal and an outer circumferential end of the spiral wiring, wherein the magnetic layer is interposed between adjacent turns of the spiral winding, the first columnar wiring has a uniform width along its entire height in the normal direction of the first principal surface, the first columnar wiring directly contacts the inner circumferential end of the spiral wiring without a via conductor having a smaller cross-sectional area than the first columnar wiring, the second columnar wiring has a uniform width along its entire height in the normal direction of the first principal surface, and the second columnar wiring directly contacts the outer circumferential end of the spiral wiring without a via conductor having a smaller cross-sectional area than the second columnar wiring.

2. The inductor component according to claim 1, wherein the magnetic layer is in contact with an upper surface of the spiral wiring in a contact portion with the spiral wiring.

3. The inductor component according to claim 1, wherein the magnetic layer is in contact with the spiral wiring from a side surface to an upper surface thereof in a contact portion with the spiral wiring.

4. The inductor component according to claim 1, wherein the insulating layer has a shape along the spiral wiring.

5. The inductor component according to claim 1, wherein the spiral wiring is only one layer.

6. The inductor component according to claim 1, wherein the side surface of the spiral wiring is all in contact with the magnetic layer.

7. The inductor component according to claim 1, wherein the spiral wiring has a spiral shape exceeding one round, and the side surface of the spiral wiring is covered with the insulating layer in a parallelly-running region of the spiral wiring exceeding one round.

8. The inductor component according to claim 1, wherein the spiral winding is not formed on a second principal surface of the insulating layer opposite to the first principal surface.

9. The inductor component according to claim 1, wherein the magnetic layer is in contact with a side surface of the spiral wiring in a contact portion with the spiral wiring.

10. The inductor component according to claim 9, wherein the insulating layer has a thickness smaller than a thickness of the spiral wiring.

11. The inductor component according to claim 9, wherein the insulating layer has a shape along the spiral wiring.

12. The inductor component according to claim 9, wherein the spiral wiring is in direct contact with the first and second columnar wirings while the first and second columnar wirings are in direct contact with the first and second external terminals, respectively.

13. The inductor component according to claim 9, wherein the spiral wiring is only one layer.

14. The inductor component according to claim 1, wherein the insulating layer has a thickness smaller than a thickness of the spiral wiring.

15. The inductor component according to claim 14, wherein the insulating layer has a thickness of 10 μm or less.

16. The inductor component according to claim 1, wherein the spiral wiring is in direct contact with the first and second columnar wirings while the first and second columnar wirings are in direct contact with the first and second external terminals, respectively.

17. The inductor component according to claim 16, wherein the upper surface of the spiral wiring is all in contact with the magnetic layer except a portion in contact with the columnar wiring.

18. An inductor component comprising:

an insulating layer containing no magnetic substance;

a spiral wiring formed on a first principal surface of the insulating layer and wound on the first principal surface;

a magnetic layer in direct contact with at least a portion of the spiral wiring;

a first columnar wiring that extends from the spiral wiring in a normal direction of the first principal surface to a first external terminal formed outside the magnetic layer, the first columnar wiring being in direct contact with the first external terminal and an inner circumferential end of the spiral wiring; and a second columnar wiring that extends from the spiral wiring in the normal direction of the first principal surface to a second external terminal formed outside the magnetic layer, the second columnar wiring being in direct contact with the second external terminal and an outer circumferential end of the spiral wiring, wherein the magnetic layer is interposed between adjacent turns of the spiral winding, the spiral wiring is in direct contact with the first and second columnar wirings while the first and second columnar wirings are in direct contact with the first and second external terminals, respectively, the upper surface of the spiral wiring is all in contact with the magnetic layer except a portion in contact with the columnar wiring, the upper surface of the spiral wiring and the columnar wiring are in direct contact without a via conductor having a smaller cross-sectional area than the columnar wiring, and the columnar wiring has a uniform width along its entire height in the normal direction of the first principal surface.

* * * * *